US005578558A

United States Patent [19]

Mueller et al.

[11] Patent Number: 5,578,558

[45] Date of Patent: Nov. 26, 1996

[54] HYDRAULIC OILS CONTAINING BIODEGRADABLE GUERBET ALCOHOLS

[75] Inventors: Gerhard Mueller; Frank Bongardt, both of Duesseldorf; Matthias Fies, Krefeld; Peter Daute, Essen, all of Germany

[73] Assignee: Henkel Kommanditgesellschaft auf Aktien, Duesseldorf, Germany

[21] Appl. No.: 583,110

[22] PCT Filed: Jul. 6, 1994

[86] PCT No.: PCT/EP94/02213

§ 371 Date: Feb. 8, 1996

§ 102(e) Date: Feb. 8, 1996

[87] PCT Pub. No.: WO95/02658

PCT Pub. Date: Jan. 26, 1995

[30] Foreign Application Priority Data

Jul. 15, 1993 [DE] Germany ..... 43 23 829.7

[51] Int. Cl.[6] ..... C10M 105/12

[52] U.S. Cl. ..... 508/577

[58] Field of Search ..... 252/52 R, 73; C10M 105/12

[56] References Cited

U.S. PATENT DOCUMENTS

| | | | |
|---|---|---|---|
| 1,945,543 | 2/1934 | Weber et al. | 252/50 |
| 2,171,491 | 8/1939 | Endres | 252/50 |
| 2,836,628 | 5/1958 | Miller | 260/632 |
| 3,899,433 | 8/1975 | Unick et al. | 252/52 R |
| 4,011,273 | 3/1977 | Abend et al. | 260/642 C |
| 5,360,560 | 11/1994 | Schmid et al. | 252/52 R X |
| 5,451,334 | 9/1995 | Bongardt et al. | 252/56 R |

FOREIGN PATENT DOCUMENTS

| | | |
|---|---|---|
| 446793 | 9/1942 | Belgium . |
| 0324558 | 7/1989 | European Pat. Off. . |
| 2320278 | 3/1977 | France . |
| 3927155 | 2/1991 | Germany . |
| 4014736 | 11/1991 | Germany . |
| WO8600300 | 1/1986 | WIPO . |

OTHER PUBLICATIONS

"Ullmanns Encyclopädie der Technischen Chemie", 4th Edition (Verlag Chemie, Weinheim), vol. 13, pp. 85 et seq. Hydraulikflüssigkeit (hydraulic Fluid) Date Unknown.

"Schmierstoffe und Verwandte Produkte" Herstellung, Eigenschaften, Anwendung (Verlag Chemie, Weinheim) 1982, pp. 147–148, 11.9 Hydrauliköle (hydraulic Oils) Month Unknown.

Soap Cosm. Chem. Spec. 52, 1987 Month Unknown.

Ullmanns Encyclopädie der Technische Chemie, loc. cit., vol. 7, p. 239 Date Unknown.

Ullmanns Encyclopädie der Technische Chemie, loc. cit., vol. 11, p. 437 Date Unknown.

*Primary Examiner*—Prince Willis, Jr.

*Assistant Examiner*—Cephia D. Toomer

*Attorney, Agent, or Firm*—Wayne C. Jaeschke; John E. Drach; Henry E. Millson, Jr.

[57] ABSTRACT

Hydraulic oils containing as a base oil at least one Guerbet alcohol of the formula R—OH in which R is a single branched radical containing from 24 to 44 carbon atoms and having an iodine value of from 20 to 150.

10 Claims, No Drawings

HYDRAULIC OILS CONTAINING BIODEGRADABLE GUERBET ALCOHOLS

This application is a 371 of PCT/EP/94/02213, filed Jul. 6, 1994.

BACKGROUND OF THE INVENTION

1. Field of the Invention

This invention relates to hydraulic oils containing at least one biodegradable Guerbet alcohol as base oil in addition to typical additives.

2. Statement of Related Art

DE-A-39 27 155. describes an environmentally friendly base oil based on natural materials for the formulation of hydraulic oils containing a rapeseed oil and/or soybean oil as the main oil component, specially selected antioxidants and a quantity equal to the main oil component of esters of trimethylol ethane, trimethylol propane and/or neopentyl alcohol with $C_{5-10}$ monocarboxylic acids or at least partly unsaturated fatty acids based on rapeseed oil, soybean oil or sunflower oil.

Although the base oils according to DE-A-39 27 155 meet standard requirements in regard to ecological compatibility, increased viscosity at elevated operating temperatures and low-temperature stability, they are sensitive to hydrolysis on account of the ester bond present in the synthetic ester.

DESCRIPTION OF THE INVENTION

Accordingly, the problem addressed by the present invention was to provide a base oil for the formulation of hydraulic oils which would be biodegradable, which would not undergo any significant increase in viscosity under oxidative conditions at elevated working temperatures and which would have a low pour point.

According to the invention, the problem stated above has been solved by a hydraulic oil containing as base oil—in addition to typical additives—at least one Guerbet alcohol corresponding to the general formula R—OH, in which R is a single-branch radical containing 24 to 44 carbon atoms and which has an iodine value of 20 to 150.

Further particulars of the composition of the hydraulic oils can be found in the relevant prior art, cf. in particular "Ullmanns EncyclopÄdie der Technischen Chemie", 4th Edition (Verlag Chemie, Weinheim), Vol. 13, pages 85 et seq. "Hydraulikflüssigkeit (Hydraulic Fluid)", and Dieter Klamann in "Schmierstoffe und verwandte Produkte" Herstellung, Eigenschaften, Anwendung (Verlag Chemie, Weinheim) 1982, pages 147–148, 11.9 "Hydrauliköle (Hydraulic Oils)".

The hydraulic oil compositions according to the invention differ from the known hydraulic oils based on mineral oil which are widely used in practice in the choice of the environmentally friendly, biodegradable Guerbet alcohols as the basic component of the hydraulic oil.

Branched fatty alcohols of the Guerbet alcohol type, which are used as the basic component in hydraulic oil compositions in accordance with the present invention, are known substances which may be obtained by the relevant methods of preparative organic chemistry. A typical process for their production is the condensation ("guerbetization") of primary linear, saturated or unsaturated alcohols in the presence of basic catalysts which proceeds via the intermediate stages of aldehydes and aldols (Soap Cosm. Chem. Spec. 52, 1987 and Ullmanns Encyclopädie der Technische Chemic, loc. cit., Vol. 7, page 239 and Vol. 11, page 437).

The Guerbet alcohols used in accordance with the invention contain 24 to 44 carbon atoms and preferably 32 to 40 carbon atoms. According to the invention, they may be used individually or in the form of a mixture of various Guerbet alcohols as the base oil component. The iodine value of the Guerbet alcohol or mixture of Guerbet alcohols is in the range from 20 to 150 and preferably in the range from 70 to 100.

Guerbet alcohols of the unsaturated fatty alcohols commercially available as HD-OCENOL™ (products of Henkel KGaA, Düsseldorf) are particularly preferred as the base oil component. One example of such Guerbet alcohols is the Guerbet alcohol of HD-OCENOL™ 80/85 which is an oleyl/cetyl alcohol with an iodine value of 84 to 89 and a $C_{18}$ component of 70 to 83%.

Other suitable Guerbet alcohols are those of the oleyl/cetyl alcohols HD-OCENOL™ 45/50 ($C_{18}$ component 60–70%, iodine value 45–50), HD-OCENOL™ 50/55 ($C_{18}$ component 55–75%, iodine value 50–55), HD-OCENOL™ 50/55 III ($C_{18}$ component 58–68iodine value 48–55), HD-OCENOL™ 60/65 ($C_{18}$ component 55–75%, iodine value 60–65), HD-OCENOL™ 70/75 ($C_{18}$ component 68–80%, iodine value 70–75), the oleyl alcohol HD-OCENOL™ 90/95 ($C_{18}$ component 87–95%, iodine value 90–97), HD-OCENOL™ 92/96 ($C_{18}$ component 87–93%, iodine value 95–105), and the oleyl/linoleyl alcohol HD-OCENOL™ 110/130 ($C_{18}$ component 90–95%, iodine value 110–130).

To produce the hydraulic oil from the Guerbet alcohol or mixture of Guerbet alcohols, other typical components have to be added in known manner. Thus, antioxidants, corrosion inhibitors, extreme-pressure additives (EP additives), anti-wear additives or pour point depressants in particular may be added to the base oils according to the invention.

The extreme-pressure additives are, in particular, sulfurized triglycerides, sulfurized fatty acid alkyl esters, sulfurized sperm oils, phosphoric acid esters, such as trioleyl alcohol phosphate or triaryl phosphate.

Particularly suitable anti-wear additives are zinc dialkyl dithiophosphate compounds, such as zinc (di-2-ethylhexyldithiophosphate).

The products marketed as EDENOR® 2410 (by Henkel KGaA, Düsseldorf) and VISKOPLEX® (by Röhm, Darmstadt) are mentioned as examples of pour point depressants. These products are polymer-based pour point depressants which infinitely delay crystallization.

Suitable corrosion inhibitors are, in particular, succinic acid semiesters, sorbitan monooleate, amine soaps of long-chain fatty acids. ADDITIN® (a product of Rheinchemie, Mannheim), EDENOR® or EUMULGIN® (products of Henkel KGaA, Düsseldorf) are mentioned in this connection.

Suitable antioxidants are, in particular, combinations of sterically hindered aromatic compounds, more particularly TBHQ (tert.butyl hydroxyquinoline) or BHT (butoxylated hydroxytoluene), and anionic antioxidants, such as in particular, BHA (butoxylated hydroxyanisole) or phenothiazine (a product of Hoechst AG, Frankfurt). A liquid antioxidant—EDENOR® VP 2465 (a product of Henkel KGaA, D üsseldorf)—which consists of a combination of anionic and phenolic antioxidants may also be used.

Further information on the particular formulation of hydraulic oils, their additives and the quantities in which they are used can be found in the prior art literature on this class of materials cited in detail in the foregoing.

The hydraulic oil compositions according to the invention contain at least 90% by weight, preferably at least 95% by weight and, more preferably, at least 98% by weight of the Guerbet alcohol or mixture of Guerbet alcohols as their base oil component.

The Guerbet alcohols forming the base oil component of the hydraulic oils according to the invention show favorable low-temperature behavior (low pour point), are not sensitive to hydrolysis, are biodegradable and, with additives, remain substantially uniform in viscosity, even under oxidative conditions, at elevated temperature.

The hydraulic oils are produced by intensively mixing the base oil component with the usual additives. Suitable methods for this purpose are known to the expert so that there is no need for further discussion here.

The following Example is intended to illustrate the invention without limiting it in any way.

EXAMPLE

Guerbet alcohol of HD-OCENOL™ 80/85 (oleyl/cetyl alcohol, 70–83% $C_{18}$ component, iodine value 84–89)

| Name: Guerbetocenol | | |
|---|---|---|
| Iodine value | (DGF C-V 11 b) | 94 |
| Acid value | (DIN 53402) | 1.0 |
| Hydroxyl value | (DIN 53240) | 100 |
| Water (K. Fischer) | (DIN 51757) | 0.08% |
| Density at 20° C.) | (DIN 51757) | 0.8589 g/cm$^3$ |
| Cloud point | (DIN ISO 3015) | −5° C. |
| Pour point | (DIN ISO 3016) | −13° C. |
| Kinemat. viscosity (Ubbelohde) | (DIN 51562) | 54.4 mm$^2$/s |
| Lovibond color | (DGF C-IV 4 b) | |
| 5¼" | | 31y / 3.5r |
| 1" | | 3.6y / 0.7r |
| Air separation capacity | (DIN 51381) | 10 mins. |
| Demulsifying power | (DIN 51599) | 20–30 mins. |
| Biodegradability | (CEC-L33 T82 test) | ≧80% |
| Baader oxidation test | (DIN 54566) | |

(7 days, 95° C.) double bond of the increase in viscosity according to DIN 51562 at 40° C:

Guerbet alcohol (no additives)

| 0 Days | 7 Days | Color |
|---|---|---|
| 54.4 mm$^2$/s | 82.27 mm$^2$/s | Green (through copper) |
| 54.4 mm$^2$/s | 82.56 mm$^2$/s | |

| 0 Days | 7 Days | Color | (Lovibond, 1") |
|---|---|---|---|
| Guerbet alcohol + 1% BHT (antioxidant, butylated hydroxytoluene) | | | |
| 54.4 mm$^2$/s | 60.80 mm$^2$/s | 62 y | 5.7 r |

-continued

| | | | |
|---|---|---|---|
| 54.4 mm$^2$/s | 61.09 mm$^2$/s | 62 y | 5.3 r |
| Guerbet alcohol + 1% Edenor VP 2465 | | | |
| 54.4 mm$^2$/s | 75.80 mm$^2$/s | 52 y | 6.8 r |
| 54.4 mm$^2$/s | 79.00 mm$^2$/s | 59 y | 7.3 r |

The low-temperature behavior (pour point) can be improved by addition of, for example, GUERBITOL® 16 (2-hexyldecan-1-ol, a product of Henkel KGaA, D üsseldorf). At the same time, the iodine value is reduced and the viscosity adjusted to a value of 46 or 32 (ISO VG).

We claim:

1. In a hydraulic oil comprising a base oil and at least one of an antioxidant, a corrosion inhibitor, an extreme pressure additive, an anti-wear additive, or a pour point depressant, the improvement wherein the base oil comprises at least one Guerbet alcohol of the formula R—OH in which R is a single-branched radical containing from 24 to 44 carbon atoms and which has an iodine value of from about 20 to about 150.

2. The hydraulic oil of claim 1 wherein in the Guerbet alcohol, R contains from 32 to 40 carbon atoms.

3. The hydraulic oil of claim 1 wherein the iodine value of the Guerbet alcohol is in the range of from about 70 to about 100.

4. The hydraulic oil of claim 2 wherein the iodine value of the Guerbet alcohol is in the range of from about 70 to about 100.

5. The hydraulic oil of claim 1 wherein the Guerbet alcohol is a mixture of such alcohols.

6. The hydraulic oil of claim 1 wherein the base oil comprises at least 90% by weight of the hydraulic oil.

7. The hydraulic oil of claim 1 wherein the base oil comprises at least 95% by weight of the hydraulic oil.

8. The hydraulic oil of claim 1 wherein the base oil comprises at least 98% by weight of the hydraulic oil.

9. The hydraulic oil of claim 1 wherein the base oil consists of the at least one Guerbet alcohol.

10. The hydraulic oil of claim 1 wherein the base oil consists of a mixture of Guerbet alcohols and comprises at least 95% by weight of the hydraulic oil, and in the Guerbet alcohols R contains from 32 to 40 carbon atoms and the iodine value of the mixture of Guerbet alcohols is in the range of from about 70 to about 100.

* * * * *